US005174389A

United States Patent [19]

Hansen

[11] Patent Number: 5,174,389

[45] Date of Patent: Dec. 29, 1992

[54] CAROUSEL WELL RIG

[76] Inventor: James E. Hansen, 3708 S. Real Rd., Bakersfield, Calif. 93309

[21] Appl. No.: 729,224

[22] Filed: Jul. 12, 1991

[51] Int. Cl.[5] ..... E21B 19/14

[52] U.S. Cl. ..... 175/52; 175/85; 414/22.66

[58] Field of Search ..... 175/52, 85; 414/22.66; 211/70.4

[56] References Cited

U.S. PATENT DOCUMENTS

| | | | |
|---|---|---|---|
| 1,868,747 | 7/1932 | Hembree | 414/22.63 |
| 2,438,277 | 3/1948 | Fife et al. | 254/139.1 |
| 2,972,388 | 2/1961 | Thornburg | 175/52 |
| 3,025,918 | 3/1962 | Leven | 175/52 |
| 3,157,286 | 11/1964 | Gyongyosi | 211/1.5 |
| 3,336,991 | 8/1967 | Klem et al. | 414/22.66 X |
| 3,337,187 | 8/1967 | Sumner | 254/2.5 |
| 3,493,061 | 2/1970 | Gyongyosi | 175/52 |
| 3,506,075 | 4/1970 | Attebo | 175/52 |
| 3,523,614 | 8/1970 | Walker | 212/42 |
| 3,664,439 | 5/1972 | Council | 175/85 |
| 3,710,954 | 1/1973 | Hutchison | 214/2.5 |
| 3,734,208 | 5/1973 | Otto | 175/52 |
| 3,741,322 | 6/1973 | Wolters | 175/52 |
| 3,913,753 | 10/1975 | Swartz et al. | 214/2.5 |
| 3,913,754 | 10/1975 | Swartz et al. | 214/2.5 |
| 3,985,189 | 10/1976 | Jahnke et al. | 175/52 |
| 3,986,564 | 10/1976 | Bender | 173/4 |
| 3,986,569 | 10/1976 | Hilding et al. | 175/52 |
| 4,128,135 | 12/1978 | Mitchhart et al. | 175/52 |
| 4,258,796 | 3/1981 | Horning et al. | 175/52 |
| 4,449,592 | 5/1984 | Mayer | 414/22.66 X |
| 4,501,524 | 2/1985 | Yoan et al. | 414/22.66 |
| 4,591,006 | 5/1986 | Hutchison et al. | 175/52 |
| 4,767,100 | 8/1988 | Philpot | 254/386 |
| 4,892,160 | 1/1990 | Schivley et al. | 175/85 |

FOREIGN PATENT DOCUMENTS

| | | | |
|---|---|---|---|
| 423917 | 10/1974 | U.S.S.R. | 414/22.66 |

*Primary Examiner*—William P. Neuder

*Attorney, Agent, or Firm*—Burns, Doane, Swecker & Mathis

[57] ABSTRACT

A well work-over drilling rig uses a single cylindrical column forming a mast for assembly and disassembly of a casing, pipe or rod forming a well string in a well bore.

The mast supports a hydraulic ram for elevating a crown block having arms radially extending equal distances from the axis of the ram. Cables are supported by sheaves at the outer ends of the arms to permit equal and opposite forces (moments) to be applied to the column by the weight of pipe sections or the complete well string. The column is stabilized by racking pipe sections, including up to the full length of a well string, annularly around the column mast on a rotatable finger-board, with substantially the full weight of pipe sections on the lower annular support. This avoids the need for lateral guy wires to stabilize the column mast.

12 Claims, 7 Drawing Sheets

CAROUSEL WELL RIG

The present invention relates to portable well working rigs of the so-called "tip-up" type. More particularly, it relates to a well rig in which a conventional derrick or A-frame is replaced by a single telescopic column that concentrically supports a hydraulic hoisting arrangement and a surrounding pipe-racking carousel capable of storing all elements of a well string vertically adjacent a well bore during assembly and disassembly of such elements in drilling, or work-over, well operations.

The single column telescopic structure of this invention substantially simplifies both the essential well pulling and pipe racking functions of the well rig so that the entire running and assembly of a well string can be automated for sequential supply of pipe, tubing or rod elements for such assembly or disassembly and racking of well elements, without human intervention. Storage of all tubular elements around the single column not only increases access of such elements for such assembly or disassembly, but also increases the stability of the telescopic structure. The resulting compactness of the structure in operation eliminates the necessity for surrounding the derrick or other structure with guy lines to hold the derrick vertically against wind or other forces. Such guy lines constitute a danger both as to the safety of the structure and to equipment or personnel working in the area. Further, they may require substantially larger areas around the derrick than is available, particularly where wells are closely spaced, or where the workover rig must be mounted on an offshore platform of exceedingly limited space. The hoisting arrangement includes a vertical hydraulic ram having a cross-head centered thereon to support a pair of lifting pulleys at opposite ends to form a movable crown block. Such dual lifting pulleys permit rigging the hoist cables so that travel at the free-end of the cables is multiplied several times that of the hydraulic ram.

A particular virtue of this arrangement is that the primary hydraulic ram may be substantially shorter than would be required for full travel of the hoist cable to run selectively either double or triple cylindrical elements, such as drill rod, casing or drill pipe, without connecting or disconnecting each individual sections forming a well string. The entire assembly of rods or pipe, or both, racked in the surrounding carousel add to the stability of an un-guyed column. This is because the weight of each pipe or rod section is concentrated at the base of the column and is distributed annularly to resist wind forces from any direction acting on the upper end of the structure. At the same time, the carousel around the hoist substantially simplifies automation of racking and unracking of vertical stored elements, since they are at substantially the same height, ready for transfer, during assembly into, or disassembly from, a well string. This in turn reduces the need for extra workers solely to transfer pipe and eliminates the need for such a worker to handle pipe at an elevated location. Further, the arrangement permits automatic handling of hot pipe. Thus the columnar rig is particularly suited for well workovers of steam enhanced producing wells since the well string can be run or pulled without cooling the well itself, or well string sections. Conservation of the thermal energy stored in the pipe, as well as that in the surrounding well bore, saves both costs to cool and heat the well and loss of time required to cool sections to assemble and disassemble a well string. Safety of workers and savings in down time of a producing oil or gas well, are additional benefits to work over jobs performed with the single columnar hydraulic hoisting and carousel racking arrangement of the present invention.

By hingedly supporting the single telescopic structure of the present invention on a movable base, such as a trailer, the rig can be driven over public roads without exceeding allowable limits of height, length or width. Further, it can be mounted on a pallet for derrick lifting from a barge or a work boat to an off-shore platform. After transport the single column is tilted upwardly from a generally horizontal position to a vertical operating position adjacent a well head. Preferably the column includes a concentric hydraulic ram unit which extends telescopically from the top of the column to a desired height suitable for selectively lifting single, double or triple lengths of well pipe or rod. The hydraulic ram includes a piston and cylinder, having a substantially shorter stroke than the length of pipe to be raised or lowered in the well bore. The movable element of the ram supports a cross head which extends radially outwardly in opposite directions and at equal distances from the column. The distance is sufficient to place one of a pair of support pulleys over the well head site. This distance is sufficient to adequately clear the concentric pipe carousel surrounding the hydraulic ram as well as a work area between such surrounding carousel and the well head. The cross head, likewise, supports a counterbalancing pulley at its opposite end so that force exerted on, or absorbed by, the hydraulic ram, as imposed by the well string, is equal at the ends of the cross head and axially parallel to both the hydraulic ram and the support column. These forces may additionally be made concentric to the column by another pair of pulleys which interconnect the stationary, or dead, end of the cable either to the hoist cross head or to a stationary portion of the column. In a preferred embodiment, the number of courses of cable travel through such pulleys, to raise or lower the well string moving the live end of the cable is at least three times that of the cross head and the hydraulic ram. Preferably, for such limited travel, the hydraulic ram is relatively large in diameter to increase the stability of the columnar structure.

Further, in accordance with the invention the concentric pipe racking carousel surrounding the single column permits a transfer arm at the top or bottom of a well element to transfer a section between a radial slot in the carousel and the well string, since only rotation of the carousel is required to align a section of rod or pipe in its vertical, hung position. In this way the section is moved by straight line, or large radial, motion from the carousel directly into alignment with the well string. Thus, the well elements are moved only vertically to raise or lower them, and transversely, or radially, with their axes, parallel to align with either the well string or one of the carousel slots after disconnection, or connection as part of the well string. Each slot is adapted to carry a multiplicity of elements, either rods or pipes. The simplicity of such rectilinear lateral movement and vertical transfer of the well elements relative to the axis of the column, greatly simplifies sequencing of actuating devices for automatic assembly, disassembly, racking and deracking of well elements. This is particularly desirable for complete automation of well workover. Such an arrangement is to be particularly desired as compared to the necessity for lifting, and tilting or rotating the axes horizontally during transfer of each element using previously known racking arrangements within a conventional derrick or in separate, external carousels.

In a preferred embodiment the hoist system multiplies the hydraulic ram movement of the cables three or more times. In such system, the cross-head is equally loaded at opposite ends by the pulleys and forms a crown block movable by the hydraulic ram. Equal loading by cables running through the crown block pulleys may be transmitted to the center of the telescopic column by at least another pair of stationary pulleys, one of which is spaced radially from the support column at the same distance as one radial arm of the cross head. The other pulley is anchored to a central stationary part of the hydraulic ram through another pulley located on the center line of the hydraulic ram. Alternatively the pulley may be positioned by another arm at an equally spaced distance radially from the hydraulic ram.

The dead end of the cable system is then anchored to the cross head at approximately the center of the hydraulic ram. In a further embodiment, the dead end of the cable system may be anchored directly to the base support of the column. Thus the hoist system may have a multiplier for cable movement of greater than three, preferably four, times the movement of the crown block by the hydraulic ram.

BACKGROUND OF THE INVENTION

U.S. Pat. No. 3,734,208—Otto relates to a portable drill rig wherein a dual section of drill pipe, within a well casing segment. Such dual sections are pivoted perpendicularly to their axes from a stored horizontal position to a vertical "ready" or "pick", so that they are in position for transfer into alignment with a well string during drilling of a well bore. All other casing and drill pipe segments are stored horizontally on the bed of a transport truck or the like.

U.S. Pat. No. 3,741,322—Wolters is directed to use of a drilling head, or power swivel, movable laterally from a position directly in line with the well bore to engage and transfer one of a few sections of pipe suspended vertically. Such pipe sections are carried by a rotatable magazine or a row of hangers, similar to a conventional "finger board" of a drilling derrick. The magazine or hanger extends along the outside of a drill mast. The drilling head or swivel is then supported from a crown pulley running on rollers along rails of a guide mast.

U.S. Pat. No. 3,025,918—Leven discloses a rotary rack for storing pipe or rods similar to that of the Wolters patent, however, the external magazine for storing rods or pipes vertically is movable both vertically and radially relative to the mast. Such movement aligns a slot in the rack with the well head, after it is moved laterally from alignment with a well head. Such movement indexes one of several rod sections into registry with the drill head, for subsequent movement into alignment with the well string. The hoisting arrangement for the well head is likewise a pair of guide rails, or rods. The well head is apparently hoisted by power driven chains along the mast support of the hoist, but not shown, except that it is above the drill rod and well head.

U.S Pat. No. 2,972,388—Thornburg is directed to an automatic drill rig generally similar to the foregoing pipe and rod transfer systems. However, the mast is tilted from horizontal to vertical by electric and hydraulic motors driving cable drums. It includes mechanical and electrical braking systems to control drill string motion during drilling. In other regards, the drill pipe storage and racking arrangements include hangers that are suspended external to the mast for transfer of drill pipe sections from the magazine into alignment with the well bore.

U.S. Pat. No. 4,892,160—Schivley, et al. discloses a rotary rack or magazine type pipe storage arrangement for non-vertical or slant well drilling. The arrangement is particularly directed to transferring pipe in a rotatable magazine that is carried in a conventional derrick. When the derrick itself is tilted, the pipe sections need to be aligned with the top of the drill string. The arrangement includes track for guiding the power swivel from alignment with the well head to one of the sections of pipe in the carousel. A pivotable transfer arm guides the lower end of the pipe section from its slanted rack to the top of the pipe section in the well head.

U.S Pat. No. 3,985,189—Jahnke, et al. shows another embodiment of a drill rod racking arrangement wherein a carousel is mounted adjacent a tilt up mast carrying a drilling head within an open box frame. The arrangement is similar to the foregoing patents, as well as U.S. Pat. Nos. 3,913,754 and 3,913,757 and 3,913,373 all to Swartz et al. Each discloses another form of drill pipe magazine swingably mounted on a mast for moving into alignment with the well string. Only a few sections of pipe are vertically stored by this arrangement. Other sections of pipe may be added to the magazine while the drilling operation continues. There is no arrangement for storing the entire string of drill elements, for rapidly assemble and disassembly of the full string.

U.S. Pat. No. 3,506,075—Attebo discloses a variation on the conventional fingerboard for well string sections. The sections are stored in a circular arc for movement by a pivotable arm to successively engage or disengage sections of pipe within the storage arc. The storage arrangement is mounted exterior to and along side a mast supporting a conventional rotary drilling head mounted in a box slideably supported in the mast.

U.S. Pat. No. 4,128,135—Mitchhart et al discloses a similar magazine, or carousel, carrying a few sections of drill pipe and is particularly directed to an arm mechanism for moving sections of drill pipe from the carousel to the drill string, or vice versa.

U.S. Pat. Nos. 3,157,286 and 3,493,061, both to Gyongyosi, disclose similar pipe magazine or carousels for storing a few sections of drill pipe. In these patents the drill pipe is pivoted into and out of position for removal or addition of sections of pipe to run the drill string in or out of a bore hole.

U.S. Pat. No. 4,258,796—Horning, et al. discloses an arrangement similar to those described above wherein the rotatable magazine, or carousel, holds a few sections of drill rod. The drilling arrangement is similar to the prior disclosed drilling head, or power swivel, supported on rails and driven by power actuated chains for lifting and lowering the drill string and power swivel.

U.S. Pat. No. 1,868,747—Hembree and U.S. Pat. No. 3,664,439 —Council, both disclose automatic racking and unracking of drill pipe in a fingerboard arrangement. In Hembree the rack is supported by a conventional derrick. In Council the upper and lower supports for the drill pipe are affixed to a tilt up mast for use in conjunction with a drilling head. In Hembree, drilling is conducted through a conventional rotary table with the drill string supported by a conventional crown block and traveling block hoist arrangement.

U.S. Pat. No. 2,438,277—Fife et al is directed to a well work-over rig which includes a tilt up mast comprising a pair of hydraulic jacks bridged by a transverse crown plate. The crown plate supports three spaced apart crown pulleys and each of the two hydraulic jacks includes a pulley mounted on a stationary cylinder. This arrangement permits rigging a travelling block on cables, in which the block moves four times the motion of the hydraulic pistons. The mast is vertically stabilized in its raised position by guy lines attached to the ends of the crown plate. No arrangement for racking tubular goods is disclosed.

U.S. Pat. No. 3,986,564—Bender disclosed another form of a hydraulically actuated well rig for running tubular members into and out of well bore. A plurality of parallel hydraulic rams are enclosed within a mast for vertically lifting a crown block, which carries a pair of oversized pulleys. Such pulleys are large enough in diameter to suspend the hoist cable over a well head adjacent the mast location. Pipe is racked in a conventional overhead "fingerboard", supported laterally by the mast. The dead end of the hoist cable is anchored to the base support for the mast. After the cable passes over one of the travelling pulleys, the active end lifts the hook twice the vertical lift of the hydraulic rams supporting the crown block.

U.S. Pat. No. 4,767,100 Philpot discloses another hydraulically actuated hoisting system similar to Bender. A pair of hydraulic cylinders lift a crown block supporting a pair of cables adjacent its opposite ends. One end of the cable is anchored to the base of the tilt-up mast so that movement of the crown block moves the traveling block twice the motion of the rams. This system does not disclose any arrangement for racking or transferring pipe.

U.S. Pat. No. 3,523,614—Walker is directed to a hoist system for a clam-shell bucket, used in dredging. Normally, gravity opens the bucket, but such opening is assisted by a hydraulic piston and pulley engaging the activating cable between two stationary pulleys mounted on a rigid vertical mast.

U.S. Pat. No. 3,337,187—Sumner, illustrates an extensible hoist where load lifting, using a drum and cable arrangement, includes a cross-bar atop a support post. It includes a pair of cables mounted at opposite ends of the transverse support so that load is equalized between the lifting hook and the elevating cable drum mounted directly on the post itself. However, it is to be noted that the cabled drum and intermediated pulley on the cross bar apply off axis forces to the column itself.

U.S. Pat. No. 3,710,954—Hutchison, is illustrative of a well drilling, or work-over, rig in which pipe, tubing, or sucker rods, are stored horizontally. The elements are lifted and turned perpendicularly to their axes for alignment with a drill string in a well bore.

U.S. Pat. No. 4,591,006—Huchinson and Hansen, is illustrative of a fully automatic arrangement for handling well elements, both going into and coming out of a well, as to which Applicant of the present invention is a co-patentee. The tubular goods are stored and retrieved from a horizontal racking arrangement.

From the foregoing it will be seen that none of the arrangements discloses a basically columnar design providing both hoisting, or mast, function for a workover rig, and an integral carousel racking arrangement concentric with the hoist and mast, that is capable of storing a complete well string during either drilling or workover of a well bore. Further, the hydraulic lifting arrangement, as well as the racking carousel, are telescopically supported by a single column so that the entire rig is collapsible into a length, height and width which permits transport of the rig within standard permissible, space limits of public highways. A particular advantage of the single columnar structure lies in the structural rigidity of the columns with pipe and rod section racked on the carousel. Such rig- idity permits operation of the columnar structure without numerous guy lines extending substantial distances around the mast. Thus the rig is particularly suitable for operation in areas having limited areas around the well head such as on offshore platforms or other closely spaced wells, such as urban areas. Further, such columnar structure permits the entire well pulling or running of well elements to be carried out without requiring manual handling of rods or pipe. Thus, it is cooling and reheating of the well or pipes, thereby saving cost and conserving energy on each workover. Since the pipe can be handled without particularly useful in thermally stimulated wells.

SUMMARY OF THE INVENTION

In its broadest aspects the present invention relates to a tilt-up well rig, wherein a telescopic cylindric column concentrically supports hoisting and pipe racking structure. The rig is adapted to be transported in a generally horizontal position so that the telescopic column may be pivotally tilted into a vertical position adjacent a well head and then erected without need of guy lines.

In such broad aspect, the column comprises an internal hydraulic actuator supporting a well string hoist system including a cross beam having its center of gravity directly aligned with the hydraulic ram. Thus, all well string load is borne axially by the column alone. The columnar structure is further characterized by providing an axially extendable carousel rack having a multiplicity of radial slots for racking well elements vertically, and directly adjacent a pipe elevator alignable with a well string in an adjacent well bore. The racking arrangement permits each of the plurality of vertical well elements to be moved radially with respect to the column from anyone of a multiplicity of slots for alignment with the well bore, and with only lateral movement of the pipe or rod either by rotation or linear movement parallel to the axis of the pipe or rod. Thus, no rotation or tilting horizontally relative to the pipe's longitudinal axis is required to rack or unrack the well elements. In a preferred embodiment, the columnar hoist system extends vertically above the carousel pipe rack hoists and lowers a well string through a cable system suspended from opposite ends of cross head mounted centrally on the movable element of the hydraulic actuator ram. The cross-head support for the cable system includes at least a pair of sheaves equally spaced laterally from each other and from the central axis of the hydraulic ram. The active end of the hoisting cable is thus suspended by one of the sheaves from the outer end of the cross head so that it hangs a pipe elevator directly in line with the well bore. The other end of the cable is suspended over an opposite sheave on the cross head so that it can be affixed to a stationary anchor either directly downwardly to the support for the column, or indirectly through another pair of sheaves. The second pair of sheaves are stationary relative to the hydraulic ram. Alternatively, with such a second pair of sheaves, the "dead" end of the cable may be anchored directly to the center of the cross head for simultaneous lift by the hydraulic ram. The hoist arrangement thus permits use of a relatively short-stroke high pressure hydraulic ram to move the length of one to three assembled elements of the well string relative to the upper and lower end of such elements into one of the slots in the upper and lower surrounding pipe racks of the carousel. Accordingly, transfer of well elements between the well and a racking position in one sets of slots, is solely by lifting and horizontal transfer of the gravity suspended, vertical, elements.

Further objects and advantages of the present invention will become apparent from the following detailed description taken with the drawings, which form an integral part of the present specification.

BRIEF DESCRIPTION OF THE DRAWINGS

FIG. 9, in particular, illustrates the hydraulic hoist in position to engage the pipe block of cable elevator with the top of a well string suspended in a well bore.

FIG. 10 shows a section of such well string lifted to its extreme upper position after it has been disconnected from the well string and elevated by the hoist mechanism to a height sufficient to strip it over an internal, alternately raised, rod string. Such alternate pulling is sometimes needed to remove successively rod and pipe segments of separate strings from a well.

FIG. 11 shows the pipe handler or transfer arm, in its engaged position to hold a disconnected pipe section after the hoist raises it to a normal position for transfer into slots of the carousel rack. This figure also illustrates rotation of both the base and upper racks of the carousel around the column to position a pipe section in a selected pair of slots.

FIG. 12 shows a well pipe being stored, or racked, in the carousel by simple rotation of the transfer arm from a position over the well head to a position to align the lower end of the pipe with a slot in the base of the carousel and within one of the upper slots. The combination of FIGS. 9, 10, 11 and 12 illustrates that the pipe segments are lifted vertically, then transferred laterally for vertical storage in the carousel, with all motions being rectilinear during both racking and unracking of well elements FIG. 13 indicates one such arrangement which includes a single extension of the hydraulic cylinder of the ram to move the active end of the cable system overlying a well bore so that it travels twice the movement of the ram. It shows running the active cable end suspended from two spaced sheaves as in FIGS. 1 to 12 carried by the crown block to a fixed end below the sheave at the distal end of the crown block.

DESCRIPTION OF THE PREFERRED EMBODIMENTS OF THE INVENTION

Figures 1, 2:
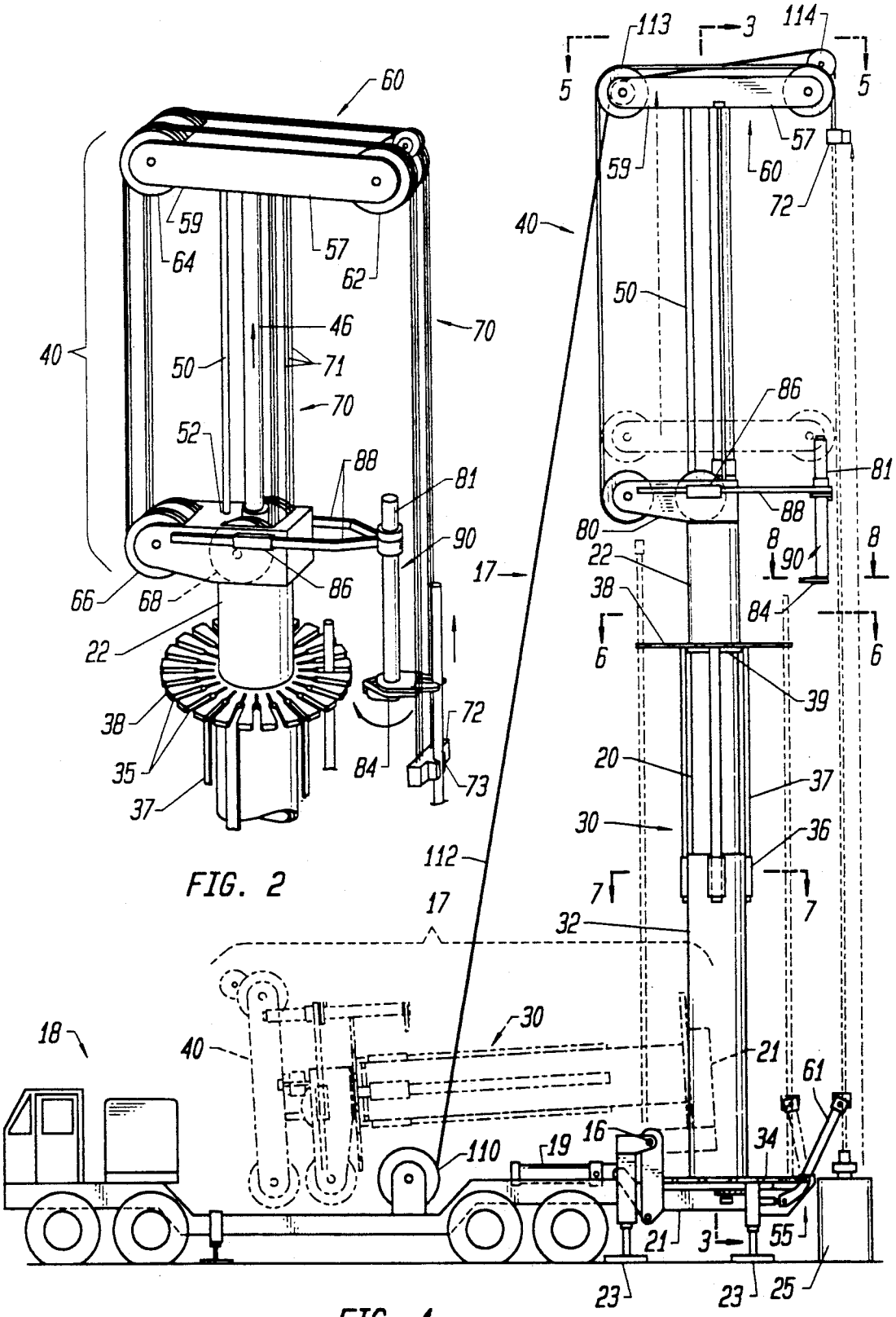
FIG. 1 is an overall elevation view of a well working rig using a single telescopic columnar mast of the present invention, wherein the combined hydraulic hoist and well pipe carousel racking arrangements are extended into an erected, tilt-up position at a well site. It also illustrates, in phantom view, the telescoped column mast assembly, as supported by a transport vehicle after telescoping inwardly and tilting down into a slightly lower than horizontal position, ready for transport over public highways without requiring special permit for passage, as an oversized load as to width, height or length.
FIG. 2 is a partial perspective view of the upper end of the telescopic column mast, illustrating the hydraulic hoist system in its upper most position for racking or retrieving a section of pipe in the integral surrounding carousel racking arrangement.
Figures 3, 4:
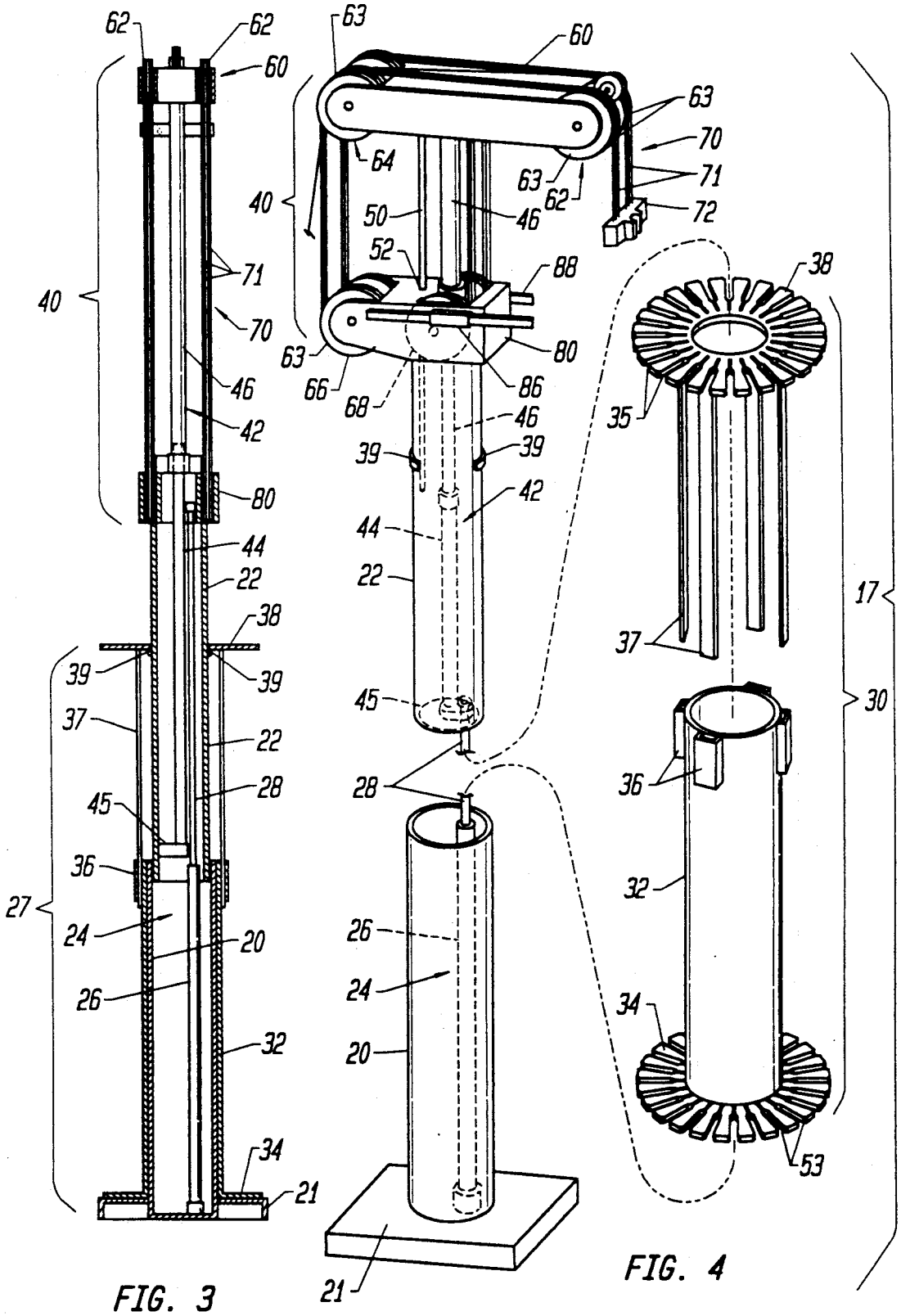
FIG. 3 is a cross-sectional, elevation view taken along the axis of the assembled mast column as seen in the direction of arrows 3—3 of FIG. 1.
FIG. 4 is an exploded, perspective view of the essential components forming the telescopic column of FIG. 1 including its coaxial carousel rack and internal hoist arrangements, with the telescopic carousel racking arrangement disassembled from its rotatable position around the support column for the hoisting arrangement, and with the hydraulic hoist ram extended from within the column to raise and lower the movable crown block and thereby lift or lower the pipe elevator supported from the sheave and cable systems.
Figure 5:
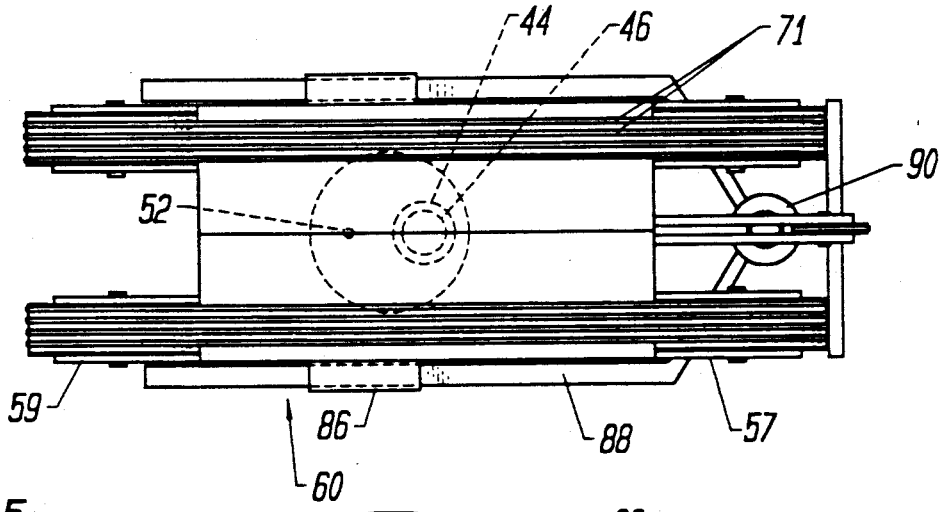
FIG. 5 is a top plan view of the hoist cable system as supported by sheaves at opposite ends of the cross-beam forming the crown block centered on the hoist ram. This view also illustrates the multiple strands and pulleys of the cable system to raise and lower the pipe elevator ,supporting a well string, or sections thereof.
Figure 6:
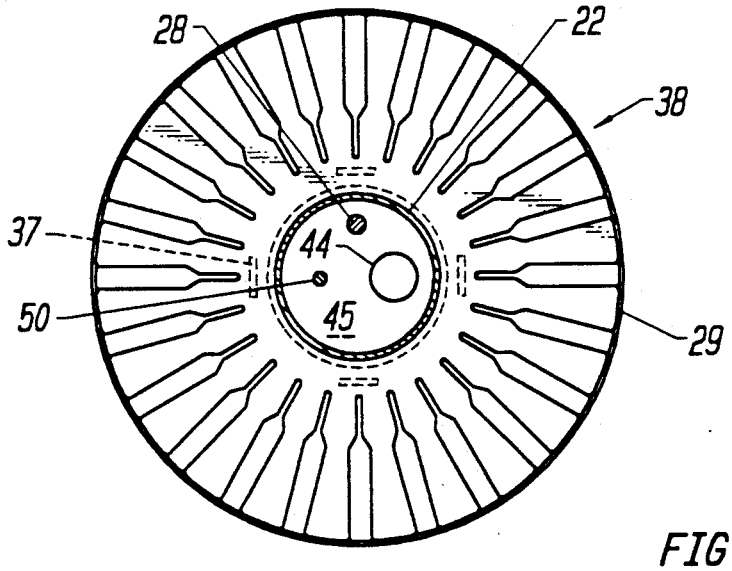
FIG. 6 is a partial cross-sectional plan view in the direction of arrows 6—6 in FIG. 1 illustrating the annular carousel racking arrangement for storing a multiplicity of pipe or rod segments, up to the full depth of such a well string, concentrically around the single column mast. The rack includes a multiplicity of rod or small pipe slots, as well as pipe, or well casing slots. In particular, it shows a multiplicity of radial slots in the annular rack which form a plurality of seats for racking all such rod and pipe sections so that each is vertically parallel, and directly adjacent, to a well head.
Figure 7:
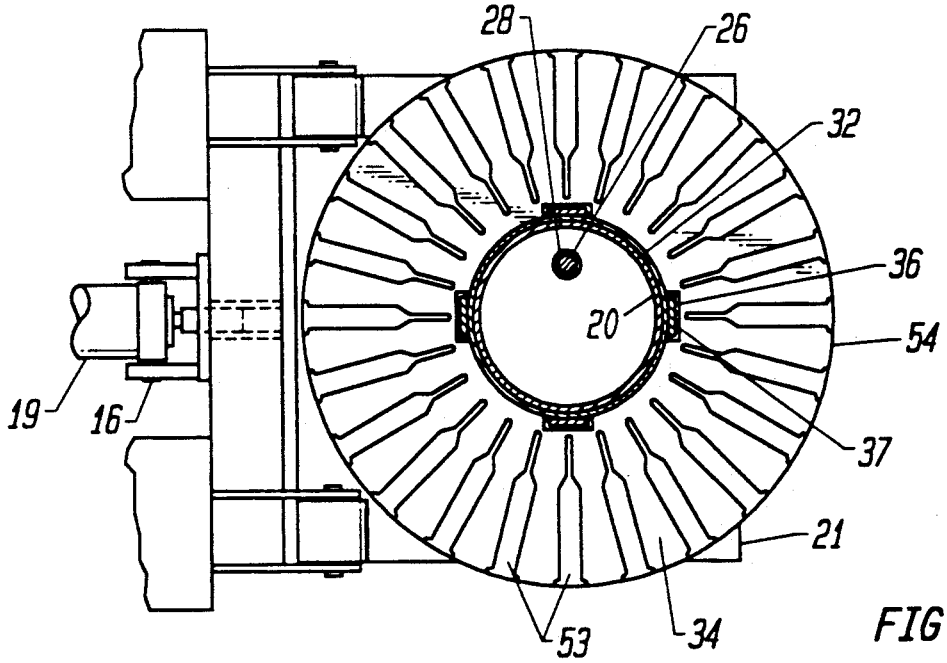
FIG. 7 is a partial cross sectional plan view in the direction of arrows 7—7 in FIG. 1, and particularly illustrates an arrangement for driving the upper telescopic section of the carousel rack assembly, as seen in FIG. 6, so that the upper annular slots turn with the annular base support for the lower ends of pipe or rod sections as the carousel is turned around base of the column mast as by rack and pinion drive means.

Referring now to the drawings, and in particular, to FIGS. 1, 2 and 3, telescopic column structure 17, which characterizes the carousel well working rig of the present invention, is shown in working position so that combined hoist assembly 40 and carousel pipe racking arrangement 30 are raised to their vertical positions adjacent, and over, a well head 25. As best shown in perspective by FIG. 2, carousel pipe racking assembly 30 surrounds cylindrical telescoping support 20 and its upward extension cylinder 22, to form support column 17. Hydraulic hoist arrangement 40, including hydraulic ram 48, within column 17 generally coaxial, but as also shown, it need not be concentric with the axis of column 17. FIG. 2 shows column 17 in its elevated position, to position arm 57 of movable crown block, or cross-head, 60 over well head 25.

Thus, as indicated, with the axis of ram 48 offset from the center of column 17, sheave 62 at the end of arm 57 extends further out radially from the axis of column 17 to provide added space for racking pipe in carousel 30. However, it will be particularly noted that arm 59 of crown block 60 is of equal radial length to assure equal and opposite loading on ram 48 and column 17. Raising block 60 lifts cable means 70 to raise pipe elevator or lift block 72, by extending cable strands 71 through crown block sheaves 62 and 64 relative to stationary sheaves 66 and 68 mounted on the upper end of cylinder 22.

FIG. 1 also shows in phantom that single telescopic column 17 is transported in a generally horizontal position. In the present embodiment, the underslung bed of truck 18 permits column 17 to be tipped slightly over center to lower the height of hoist crossbeam 60 for transport under standard permissible limits of height, weight, and length on a public road. For stability during such moves, this also lowers the center of gravity of hoist assembly 40 slightly below pivot pin 16. As indicated in full line by FIG. 1, single support column 17 is then elevated to vertical by actuation of hydraulic actuator 19 to tip column base 21 from vertical to horizontal about main pivot pin 16 supporting column 17 during travel. Column base 21 is then leveled and stabilized by jacks 23 so that cable system 70 hangs pipe elevator 72 directly over well head 25.

As also shown both in phantom and full line by FIG. 1, carousel assembly 30 surrounds sections 20 and 22 of telescopic column 17 so that it likewise telescopes to a proper length to assure that carousel column assembly 17 is sufficiently compact to meet standard road requirements.

In assembled form my single column mast rig comprising integral hoist assembly 40 and annular carousel 30, is best seen in greater detail in FIGS. 3 and 4. FIG. 3 shows unitary column 17, in a cross-sectional elevation view through its assembled and elevated configuration. FIG. 4 is an exploded perspective view of the primary elements of FIG. 3, with carousel 30 separated from column 27. As illustrated tubular structural sections 20 and 22 form a unitary support column 27, for overlying hoist mechanism 40. This view also shows a preferred method of rigging strands 71 of cable assembly 70 through sheaves 62, 64 66 and 68 to generate three times the movement of hoist 40 by pipe elevator 72 at the active end of cable 70.

The telescopic structure of single column 17 is characterized by a single cylindrical steel column 27, preferably formed of a pipe 20, say 30 to 36 inches in diameter, secured within an opening in base 21 as by welding or the like (not shown) to support inner column section 22, having hoisting mechanism 40 mounted at its upper end. Inner column 22 is preferably elevated by hydraulic ram 24 which includes hydraulic cylinder 26 and piston or ram 28 which lifts base 45 extending across the inner area of column 22. Upper section 22 is desirably locked in its elevated position at any desired height, by mechanical latches, or the like (not shown) to form a support base for actuator 42 for hoist 40. In the present embodiment this height is adequate to provide clearance for a racking or rod elements, which have a length on the order of 30 feet. Concentric cylindrical sections 20 and 22 then form column 17 having high structural strength and stability capable of elevating a complete well string. Such a configuration as an axial column resists buckling and bending moments that may be applied to the rig. At the same time, such an axially column rotatable mounts surrounding pipe racking carousel 30 so that pipe racked therein increases the column stability of the column.

The significant elements of carousel 30 comprise rotatable annular base 34 mounted on the lower end of elongated cylindrical collar 32 surrounding section 20 of column 27 and annular upper rack 38, also driven by collar 32. Upper rack 38 forms an upper "fingerboard" and is rotatable supported by annular collar or guide 39 carried on the outer surface of column section 22. By this arrangement, collar 39 lifts and lowers fingerboard 38, when inner support section 22 is elevated by hydraulic jack 24. Annular fingerboard 38 in turn is rotated with annular base 34 and lower cylindrical collar, or section, 32 by four drives sleeves 36 affixed to the upper end of collar 32. Sleeves 36 in turn drive connecting rods or bars 37 depending from rack 38. This arrangement permits lower base 34 to rotate annular fingerboard 38, irrespective of its selected elevation, as inner telescopic support section 22 is raised or lowered. As will be appreciated, the concentric configuration of lower cylindrical section 32 forms a spool like support for pipe racking carousel 30 and tubular goods stored in it. In operation base 34 will support the weight of all sections of rods or pipe racked in carousel 30. Drive of carousel 30 is through motor means (not shown) rotating annular base 34, preferably supported by roller or ball bearings (not shown) between column base 21 and annular base 34.

Ram 24 primarily positions main hydraulic actuator 42 to support hoist system 40 at a desired height. As shown, ram 42 comprises stationary cylinder element 44 and movable piston 46. As shown in FIG. 3, upper crosshead, or crown block, 60 is centrally supported to the upper end of piston 46. Cylinder 44 is carried by bracket 45 mounted within the lower end of telescopic section 22. While as indicated in the drawings, hydraulic actuator, or hoist ram, 42 is parallel to the center line of telescoping sections 20 and 22, but it is not coaxial so that greater clearance is provided between the outer edge of carousel rack 38 and well head 25. As noted above, ram 42 need not be concentric because the basic load, imposed by cable system 70 through hoist system 40 is borne within the full circular area column 27, including both sections 20 and 22. Thus, movable crown block 60 is supported entirely within the cross-sectional area of the upper end of upper section 22 and column 27 of mast 17.

To further assure that all loads placed on the single column structure 27 are axial, rather than bending or twisting moments, the structure of hoist assembly 40 is particularly critical For this reason it will be understood that all well string loads applied by cable system 70 are substantially vertical and each course of multiple cable strands 71 is counterbalanced by equal and opposite vertical forces at equally spaced distanced from the center of crown block 60. In this way the load imposed by several tons of pipe lifted or lowered into adjacent well bore 25 is always parallel to the axis of single column 27. For this reason, movable crown block 60 is desirably constructed so that arms 57 and 59 are equal in length and support a pair of sheave assemblies 62 and 64, each including a plurality of parallel pulleys 63 at opposite ends of crown block 60 and both equally spaced from the centerline of cylinder 48. Each multiple cable strand 71 is carried by one of a plurality of parallel pulleys 63 of sheave 62 to support pipe elevator 72 at the active end of cable system 70. Cable strands 71 pass from sheave 62 to sheave 64 and then vertically downwardly from sheave 64 to stationary sheave 66. With sheave 66 directly below sheave 64, all tensile forces on cable strands 71 are made equal to downward forces applied through sheave 62 during lifting or lowering a well string through pipe elevator 72. This results in opposing moments on movable block 60 that are equal in magnitude at the same distance from ram 42. In turn sheave 66 is supported by stationary block 80 at the same radial distance from column section 22 as sheave 64.

In a preferred embodiment, cable strands 71 pass over another set of pulleys forming sheave 68, and strands 71 then anchor the other end of cable system 70 to the center under side of movable crown block 60 so that the tensile forces are generally equal around the connection between piston 46 and crown block 60. This anchorage avoids off-axis loads on column 40. Such anchorage to the underside of cross head 60 in particularly advantageous in this combination of vertical courses for cable strands 71 in that for each linear foot of movement of piston 46 to raise or lower crown block 60 results in 3 feet of movement of pipe elevator 72. Thus, to connect or disconnect a stand of pipe or rod, for racking in concentric carousel fingerboard 38, piston 46 need travel only one-third the length of one pipe or rod stand. Thus, to lift a single section of pipe or rod 30 feet, piston 46 needs to travel only 10 feet. With such limited travel of block 60, the overall stroke of ram 42 is substantially shorter, making possible use of a ram having a large working diameter so that equal lift capacity is obtained at lower pressure.

To maintain alignment of movable crown block 60 with stationary crown block 80, guide rod 50 is secured to the underside of movable crown block 60 and extends through guide bore 52 in stationary block 80 and downwardly into telescopic column section 22.

Figure 8:
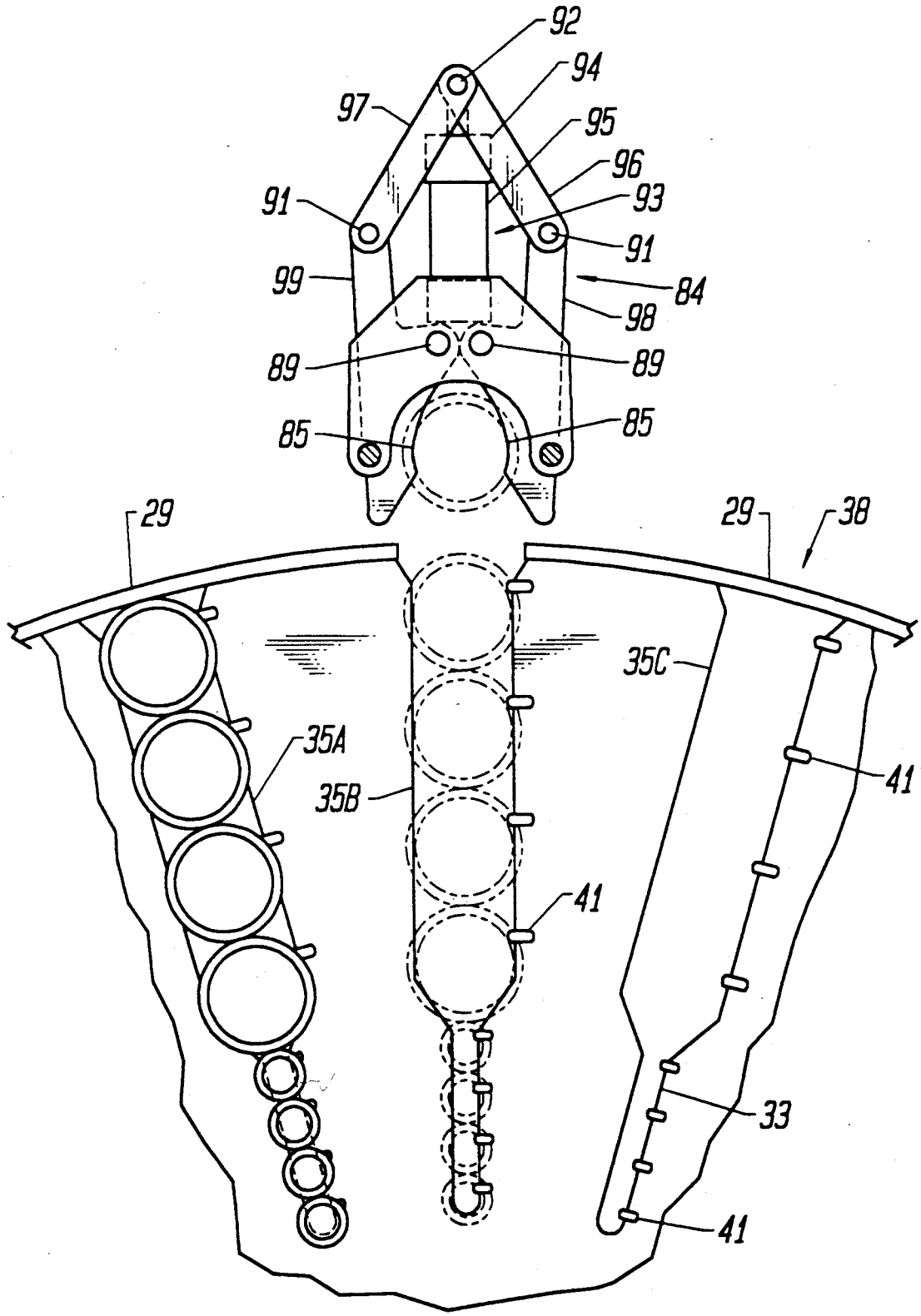
FIG. 8 is an enlarged partial sectional plan view of the radial slots of the upper carousel rack shown in FIG. 6. It additionally illustrates upper transfer arm mechanism for carrying pipe or rod sections to or from any selected position within one of the slots, either to store or retrieve one of the well elements.

Transfer of pipe or rod sections, between the well and concentric carousel 30, without pipe rotation from horizontal, or inclined, storage to vertical, is solely by vertical lift or descent of elevator 72 and horizontal rotation or straight line translation of the axis of such a section by pipe handler 90. As seen in FIGS. 1 and 2, stationary block 80 supports pipe handler 90, forming the manipulator or transfer means on a pair of arms 88 extending toward hoist cables 71. Guides 86, which may include guide rollers (not shown), support bars 88 to permit horizontal extension or retraction of vertical telescopic arm 81 carrying pipe handler hand 84 at its lower end. Pipe handler hand 84 carries pipe grips 85 that may be oscillated or reciprocated between a position either in line with pipe sections vertically suspended by pipe elevator 73 over well head 25 or a selected slot of multiple slots 35 in finger board 38 after carousel 30 is rotated to bring the opening to one slot directly opposite cable 70. As indicated in FIG. 8 each slot 35 extends radially inwardly from the outer circumference of annular fingerboard 38. Preferably pipe grips 85 directly engage a pipe section under its upper pipe coupling. Such well pipe or rod normally includes either an integral coupling collar section, or a separate collar, affixed to the end of the pipe. Such pipe couplers or collars permit the pipe to be lifted or lowered vertically while suspended within a slot or seat 73 in elevator 72. Bars 88 move arm 90 laterally by mechanical drive, such as rack and pinion means, or preferably by hydraulic means for rapid movement of pipe or rod sections between slots 35 and seat 73 of elevator 72.

As best seen in FIG. 8, when pipe handler, or transfer, hand 84 is rotated by tube 90 to engage a pipe section in slots 35, pipe grips 85 are extended and retracted by hydraulic or pneumatic ram 93, including piston 98 and cylinder 95, acting on scissors arms 96 through central pivot 92. Piston 98 rotates a pair of scissor arms 96 and 97 about pivots 91 and 92. Thus, when piston 98 is retracted within cylinder 95, scissor arms 96 rotate outwardly to turn arms 97 inwardly, thereby to close grips 85 around a pipe or rod below a pipe collar. Release of the pipe is by reverse action. That is when piston 98 is retracted by ram 93 and grips 85 open to release the pipe.

As further indicated in FIG. 8 individual sections of rod or small tubing can be stored in inner radial portions 33 of each slot 35. Each section of pipe, including "doublets" or "triplets" are held at the inner most position of the space available by spring activated detent pins 41. As each pipe section is being racked or unracked, pins 41 close or open by lateral movement of the pipe depressing each pin to hold or release the pipe. Positioning of several sections within slots 35 is indicated in upper slot 35A of carousel rack 38. Center slot 35B of FIG. 8 indicates the condition of pins 41 prior to inserting sections of pipe. Lower slot 35C indicates no pipe in the slot. It will also be noted in connection with carousel hanger 38 that each slot 35 prevents pipe or rod sections from moving laterally out of the slot by ring keeper 29. When carousel 30 is indexed to bring the next open slot into position opposite well head 25, either for removal or storage of another group of each rods or pipes, ring 29 is gapped so that pipe can be moved in or out of that slot 35. In all other positions ring 29 covers the outer ends of slots 35. It will also be apparent that pipe hand 84 may also be hydraulically extended or retracted vertically by tube 90 to lift pipe sections held by grips 85. Such movement lifts or lowers pipe, out of or into pipe lift block 72, and out of, or into, slots 35, for transfer of such sections between any pipe racking slot 35 and elevator slot 73.

While not shown in detail in FIG. 4, the upper surface of rotatable base 34 of carousel 30 may include a similar lower fingerboard 31 having indentations or slots 53 similar to slots 35 of upper fingerboard 38. The ends of slots 53 are similarly closed by band 54 in all positions except when opposite well head 25.

Figures 16, 17, 18:
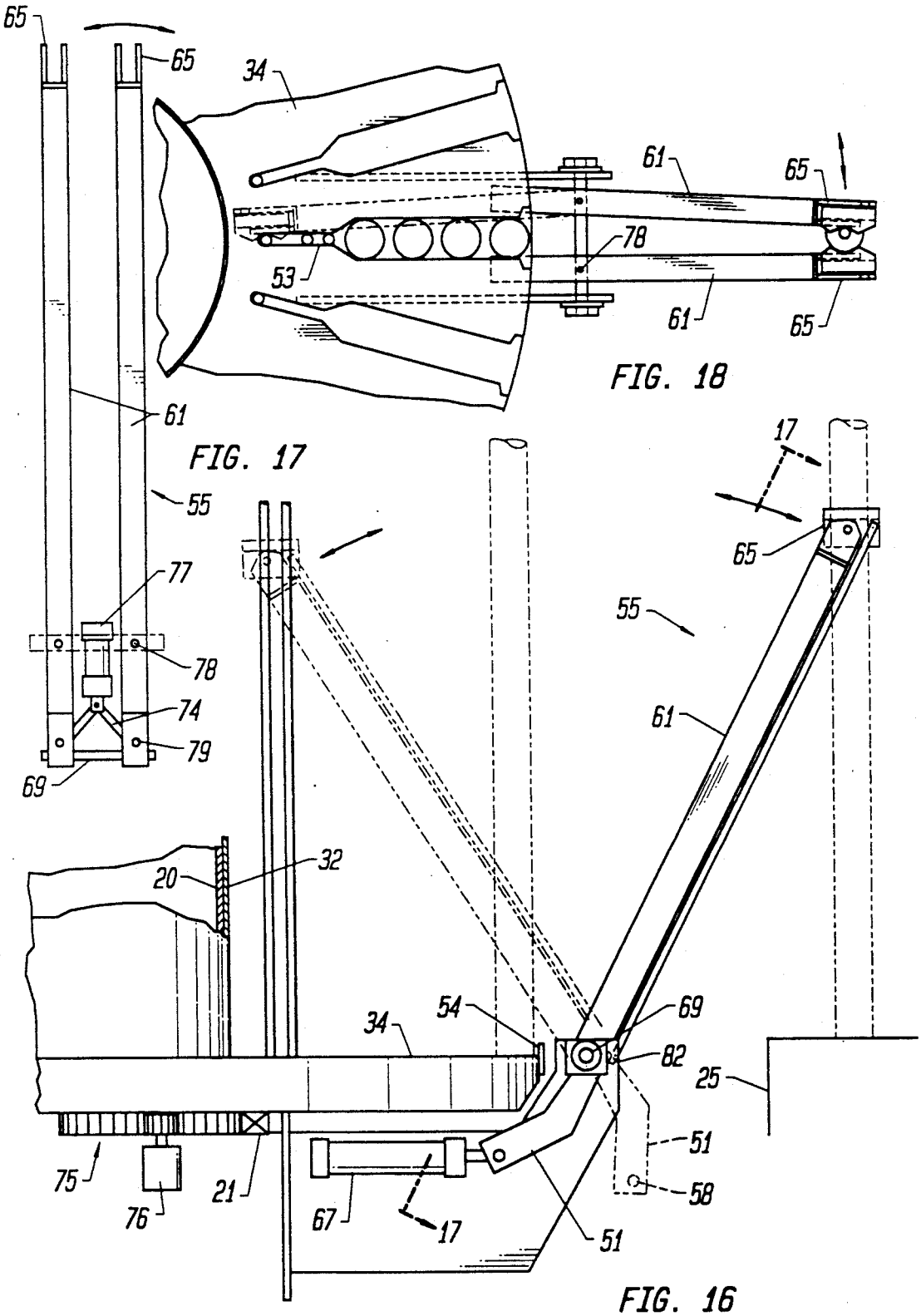
FIG. 16 is a partial side elevation view of the pair of bottom pipe racking arms, showing in full the arms pivoted to engage a pipe section in line with the well head, and in phantom, the pivoted position of the arm to rack the bottom of sections of rod, tubing, or well casing, onto the lower carousel base.
FIG. 17 is a plan view in the direction of arrows 17—17 in FIG. 16 illustrating the pair of racking arms in open position to engage a rod or pipe section.
FIG. 18 is a top plan view of the bottom racking arms of FIG. 16 and 17, showing in full line the arms engaging a pipe section in line with the well head, and in phantom, the arms engaging a rod or tubing section landed on the bottom carousel base.

Loading of pipe or rod sections onto base 34 is desirably assisted by a pipe handling means such as bottom rack 55, having a pair of pivot arms 66. As best seen in FIGS. 16, 17 and 18, bottom arm 55 is pivotable in a vertical plane about pivot pin 69 by hydraulic ram 67 supported beneath base 21 and pivotally connected by pin 59 to the lower ends of arms 61, which in turn are in line with the receiving slot 53 of bottom fingerboard 34 directly opposite well head 25. Since bottom arms 61 do not need to support the weight of pipe sections during transfer, nor do they need to rotate, arms may be formed as a pair scissor arms 61 which include pivotable "shoes" 65 adopted to grasp the pipe. Scissor arms 61 may include pivot means for both, or only one, of arms 61, as shown in FIG. 17, activated by ram 77 through pivots 79, to open and close shoes 65 around the pipe. Desirably, bottom arm 55 is also movable between well head 25 and rotatable base 34 as by a rack and pinion arrangement 75, supported below base 21 and driven either electrically, as by motor 76, or hydraulically, to extend the reach of the shoes 65 to move pipe deeper into or out or each slot 53 by lateral movement the support for arms 61 and their rotation about pivot 69.

As will be apparent, each well element is basically supported by lower fingboard 34 so that substantially the full weight of disassembled well elements is concentrated at the base of column 17. This is particularly significant to the stability of the entire carousel rig since it avoids the need for lateral bracing, particularly the use of laterally anchored guy cables.

FIGS. 9, 10, 11 and 12 illustrate schematically a sequence of steps performed by the carousel rig 17 to disassemble and rack sections of drill pipe or rod from a well bore controlled by well head 25. It will be recognized that these figures represent hoist mechanism 40 and concentric pipe racking carousel 30 around single column structure 17, as seen in at right hand portion of FIG. 1. The rig is erected at a position adjacent well head 25 so that hoist cable system 70 suspends pipe elevator block 72 over the centerline of well head 25. As particularly shown in FIG. 9 travelling crown block 60 is in its lowered position, just above stationary crown block 80, to place slot 73 of elevator 72 just under the collar of the top most tubing section, or rod, of a well string still in well head 25. In such condition, the end of the uppermost pipe section is in a position to be gripped by conventional "slips", schematically represented at 100. With such a section of pipe above the slips and free of the well head, the well string can be hoisted to a height where the next pipe coupler is above the well head and can seat the string in the well head slips. The free section 101 of the string can then be engaged by power tongs (not shown) to break and unscrew the exposed pipe section that is to be disconnected and racked.

Figure 11:
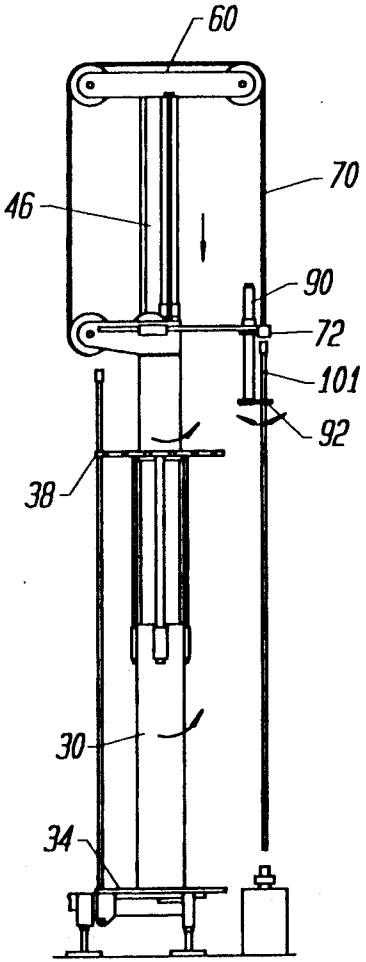

FIG. 11 illustrates the beginning of racking, or deracking, of a tubing section 101 suspended by cable 70, after hydraulic ram 46 has lifted crown block 60 to its normal elevated position. In such position, pipe handler arm 90 is able to bring grips 85 of hand 84 into a position to transfer stand 101 to, or from, carousel 30. Hand 84 of pipe handler arm 90 is then rotated into a position to grip pipe section 101 from under elevator 72. Transfer is then by rotation so that grip 85 comes into alignment with pipe section 101 to enter open slots 35 of carousel fingerboard 38. As indicated, slot 35 has been previously rotated into position directly opposite well head 25.

Figure 12:
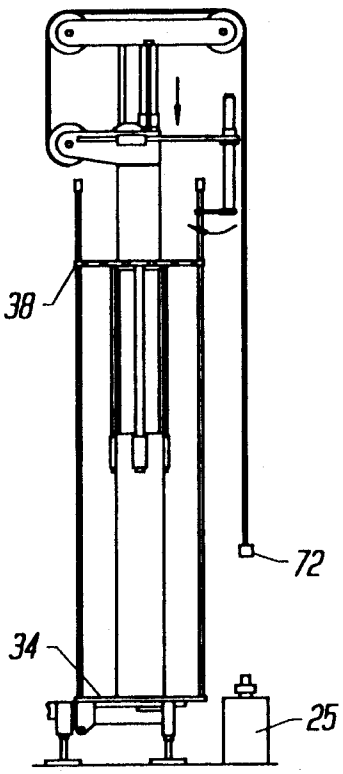
FIGS. 9, 10, 11, and 12 illustrate schematically steps to retrieve or store sections of well elements, such as single, double or triple lengths of pipe coupled together, to make up or break a continuous well string.

Although not shown, lower fingerboard 34 is also aligned with bottom rack arm 25 (not shown). FIG. 12 shows pipe section 101 landed in slot 35, with its lower end resting in slot 53 for primary support on carousel base 34. At the same time that pipe section 101 is being racked by upper pipe handling arm 90, elevator 72 is again being lowered by hoist assembly 60 and cable system 70 to engage the next section of the well string to be pulled from the well bore. Such simultaneous racking and lifting substantially improves the efficiency of the unit in reducing overall time required to run pipe forming a well string either to rack or assemble such sections. It will be understood of course that assembly of a well string is the reverse of the pulling and racking methods illustrated by FIGS. 10 and 12.

Figure 10:
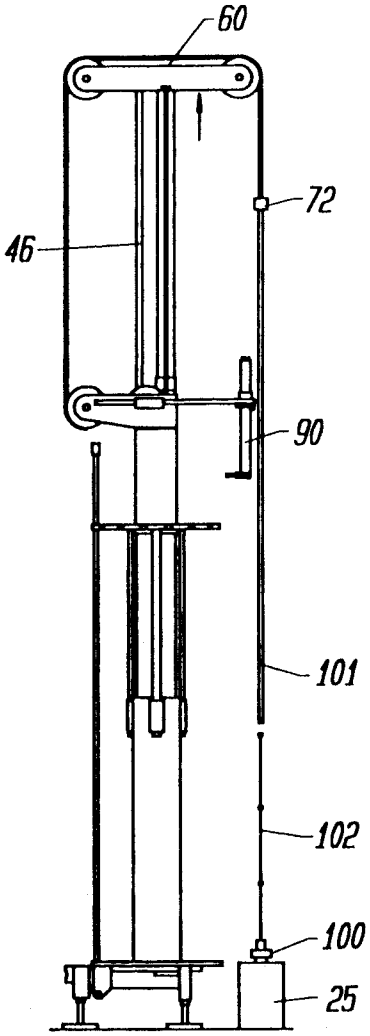
Figure 9:
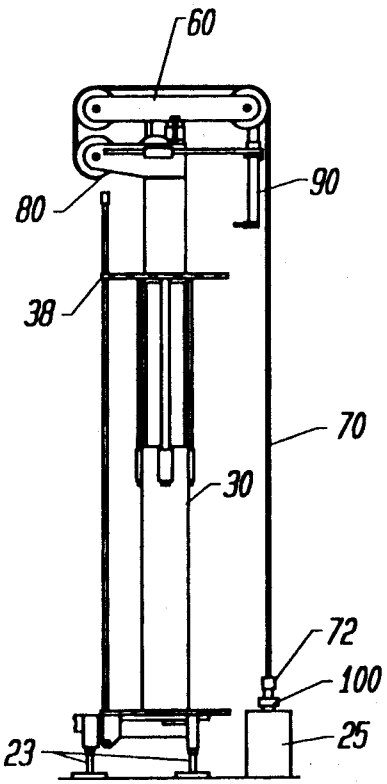

FIG. 10 illustrates use of the carousel rig to "strip" pipe over smaller tubing or pump rods, to simultaneous run both strings. As there shown, after pipe section 101 is disconnected from the well string hoist 60 is raised to a maximum height permitted by hydraulic ram 46 This clears pipe 101 from rod string 102. From this elevated position pipe section 101 is lowered to the position shown in FIG. 11 for normal racking. The next section of rod string 102 may be pulled as in FIGS. 11 and 12 for similar racking in an adjacent slot 35. It will be noted, particularly in FIGS. 9 to 12, that elevator 73 is continuously in contact with pipe sections as they are being raised and lowered. This is made possible by seat 73 being at the center of elevator 72 and between lines 71, attached to its outer ends. Thus, hand 84 is able to grasp the pipe to raise the pipe collar out of seat 73 by elevation of arm 90. At this point, hoist 60 is free to lower elevator 72 back to engage the next section of pipe still connected to the well string, without requiring human intervention.

It will be particularly noted that substantially all of the pipe and rod sections are primarily carried at lower end of carousel 30 as formed by annular base 34. Accordingly, rig column 17 requires no lateral bracing, as by guy lines and lateral anchors. Such guy lines are dangerous and may consume considerable lateral area around the working rig. They also may interfere with operation of equipment around the rig, including its set-up and removal from the well site. Such lines are also a serious danger both to those who may run into them and to the stability of the mast itself.

Figure 15:
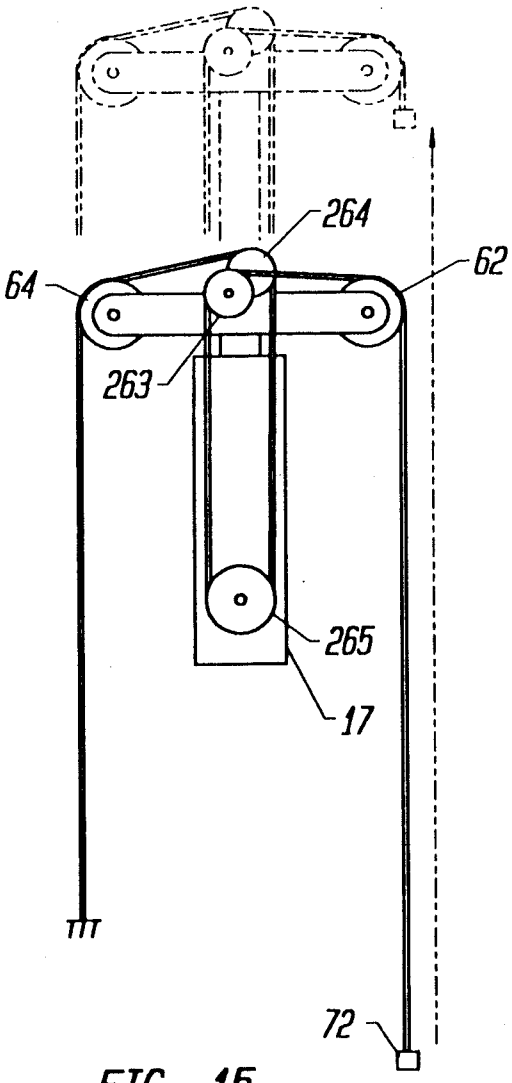
FIG. 15 illustrates an alternative arrangement to that of FIG. 14 to generate quadruple movement of pipe elevator 72 for the amount of motion, or displacement, of crown block 60 relative to support column 17. In this embodiment auxiliary sheaves 263 and 264 are mounted adjacent the axis of crown block 60 so that they align with a single stationary sheave 266 supported along the centerline of ram 42. The two embodiments of FIGS. 14 and 15 are particularly useful where double or triple sections of pipe are to be racked or run.
Figure 14:
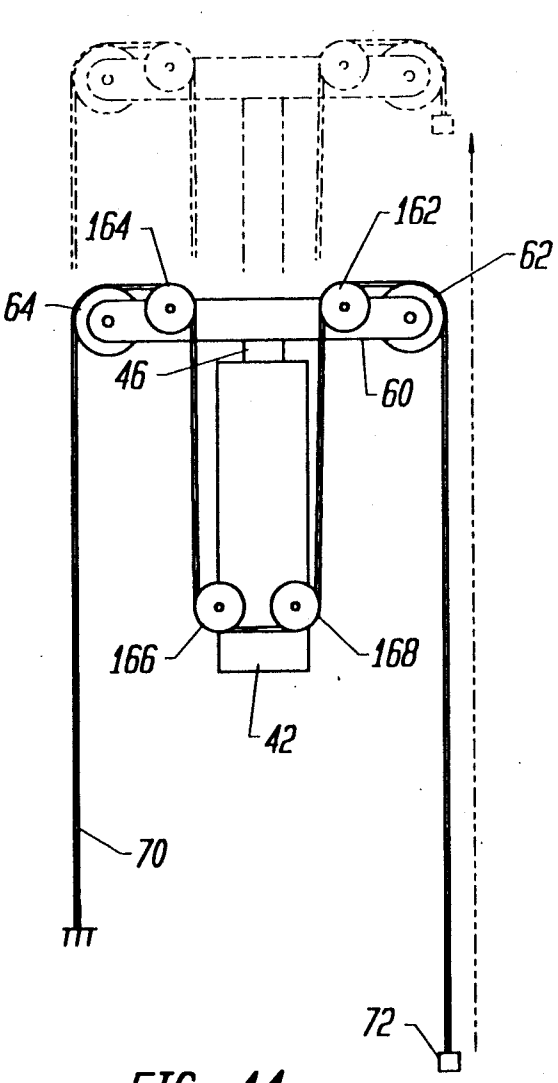
FIG. 14 illustrates an alternative arrangement in which hydraulic ram motion is amplified four times at the pipe elevator end of the cable by running the cable through four vertical courses, each of which extends or retracts with movement of the crown block.
Figure 13:
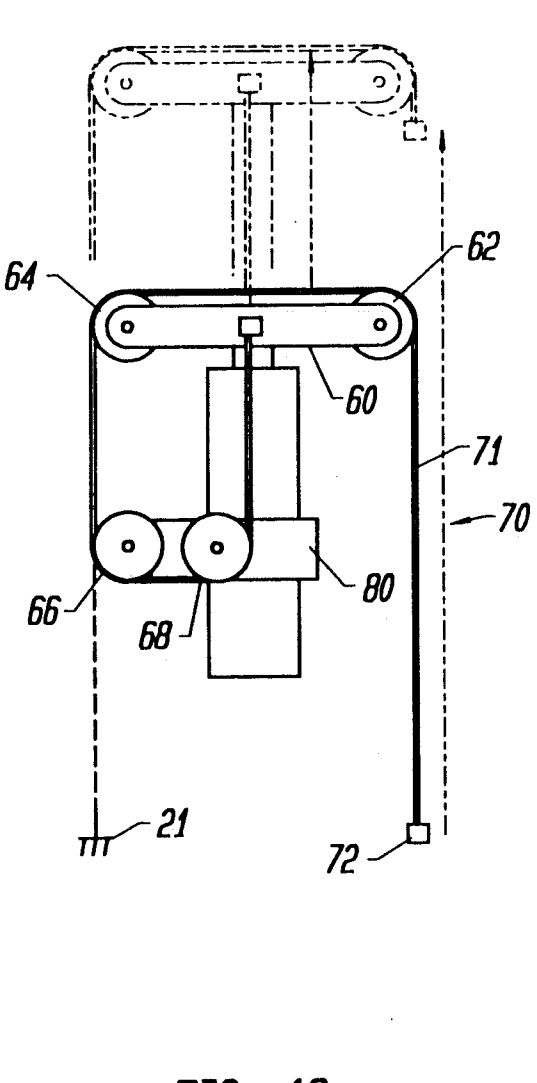

FIGS. 13, 14 and 15 illustrate various alternate arrangements for rigging the hoist cable system over the movable crown block 60 so that all loads are axial to the support column and counter-balanced at its ends by equally spaced pairs of lifting sheaves so that all loads are centered with respect to the hydraulic actuator and structurally within the column. In these alternate embodiments, multiple strands 71 forming cable 70 may take several difference vertical courses to elevate or lower a pipe string during each extension or retraction of hydraulic piston 46 as it lifts movable crown block 60 above stationary block 80. The arrangement of FIG. 13, for example, illustrates the cable arrangement of FIGS. 1 to 12 in which elevation of crown block 60 lifts a single set of sheaves 62 and 64, and the dead end of the cable is anchored to the under side of crown block 60 through stationary sheaves 66 and 68. Such an arrangement, as noted above, generates three times the movement of hoist 60 at elevator 70. Alternatively, as shown in phantom, the lines from sheave 64 may be anchored to the column base 21 or some other non-moving part of vertical column 17, directly vertical below sheave 64. The basic requirement of such an arrangement is that only vertical loads are applied to the column. Accordingly, all lateral loads on the column, primarily the well string, that would induce turning moments are counterbalanced by a similar turning moment at the restrained end of the cable. The arrangement of sheaves 62 and 64 at opposite ends of crown block 60 only results in cable movement twice the travel of crown block 60.

FIG. 14 illustrates another embodiment of the present invention in which movement of elevator crown block 60 is amplified four times by auxiliary sheaves 162 and 164 equally spaced along crown block 60 and both radially opposed from piston 46 by a pair of stationary sheaves 166 and 168 mounted at equal distances relative to ram 42. Cable 70 is anchored to ground or any stationary part of the rig at the opposite side of crown block 60 and vertically in line with sheave 64.

FIG. 15 is a further embodiment for generating four times the movement of elevator 70 by each unit of movement of crown block 60. In this arrangement another pair of sheaves 263 and 264 are equally spaced from the center of the crown block and in line with the axis of piston 46 and a single stationary sheave 265 is supported on column 17. The dead end of cable 70 is anchored as in FIG. 14.

It will of course be understood from the foregoing description that the entire well workover, or drilling, rig disclosed in the present invention is a self-contained unit wherein transport means, such as truck 18, includes adequate hydraulic and electric power to actuate each of the hydraulic rams, or motors, or electric motors, as they may be required to perform various functions of assembling, disassembling and racking pipe tubing or rod elements, as illustrated in connection with the present well servicing rig. Although not shown, it will be understood of course that a heat exchanger for hydraulic operating fluid is particularly desirable in connection with such a hydraulic rig, primarily because dissipation of energy absorbed as heat by the hydraulic fluid oil in lifting or lowering up to sixty tons of pipe over a relatively short time is essential. Such fluid requires that its viscosity and lubricity not vary substantially, because control mechanisms for hydraulic actuators require balancing hydraulic forces at each end of a piston element moving within the cylinder of such actuators. It will also be understood that adequate cooling of the operating fluid substantially improves precision in locating a fixed position of an actuated element to stop, accelerate, or move at constant velocity Such control is not readily achievable with mechanical actuators controlled by brakes or cables which must absorb and dissipate such heat, as in conventional well rigs for drilling or well work-over. It is to be noted that multiple cables strands 63 are preferably spun of Kelvar TM (or similar) to reduce overall weight of the single column supported carousel rig, without loss of strength.

As specifically illustrated in FIG. 1 hoist assembly 40 supports an independent cable pulley 114 for raising and lowering well tools, independent of hoist elevator 42. Such a cable is normally called a "sand line" because it is most frequently used to run a sand bailer in the well. A sand reel, represented by cable drum 110, mounted on the bed of truck 18 to run line 112 for auxiliary work such as bailing, sand, scratchers, placement of gravel particles, and the like. Since none of these operations involve lifting great weights, as required for successive lifting and disconnecting sections of pipe, the entire operation can be conducted by running cable 112 over a pair of auxiliary pulleys such as 113 and 114, mounted at opposite ends of movable crown block 60 so that the active end of cable 112 is suspended directly above well head 25.

While the foregoing detailed description illustrates the columnar working structure for both pulling (or running) and stringing tubular elements for well working and the principles of operation in performing such well working methods of the present invention, it will be understood that various modifications and changes may be made in the individual elements making up the uniform column to support a hydraulic hoist at its top and a concentric pipe or rod racking carousel without departing from the spirit and scope of my invention. All such modifications or changes coming within the spirit and scope of the claims are intended to be comprehended by them. Among such obvious modifications it will be apparent that the hoist system within the single column support may comprise several hydraulic rams, rather than a single ram. These rams may be in parallel to share the lift load on the crown block and at required distances to maintain balance of all vertical forces. The rams may also be arranged in series, so that successive, hydraulic ram has a shorter stroke. The series of rams would be stacked one upon the other to achieve a desired length of travel by crown block 60.

While it is preferable that there be no rotation of crown block 60 relative to carousel 30, it is within the intent and scope of the claims that the entire hoist assembly 40 may be partially or fully rotatable about single column support 21 to load sections of pipe into carousel 30 that is either held stationary, or is only partially rotatable around column 12 relative to crown block 60.

I claim:

1. Apparatus for assembling and disassembling a well string of cylindrical elements and storing such elements vertically adjacent to the well string during such assembly and disassembly comprising a single column mast including a hydraulic hoist having a hydraulic ram member extending axially within said column mast for vertical extension and retraction above the upper end of said mast, said hoist ram including a movable crown block including a pair of diametrically opposed cross arms extending laterally from the center of the upper end of said hoist with one arm adapted to extend over an adjacent well bore containing a well string, hoist cable means having an active end extendable and retractable to lift and lower a well string, said hoist cable means being supported by at least a pair of sheaves equally spaced laterally from each other by the outer ends of said cross arms, one of said sheaves being adapted to suspend said active end of said cable means over a well bore and the inactive end of said cable means passing over the other of said pair of sheaves to permit said inactive cable end to be secured to at least one anchor means in vertical alignment with said other sheave, a pipe racking carousel surrounding the lower end of said column mast for temporarily storing elements of a well string during assembly or disassembly of said well string from, or into, a well bore, said racking carousel being rotatably supported and concentric with said column structure and including an upper annular fingerboard having a multiplicity of radial slots extending radially inwardly from the circumference of said carousel, each of said slots including means for supporting the upper ends a plurality of elements forming a well string so that each said element is parallel and adjacent to said active end of said hoist cable and transfer means for selectively transferring a vertically suspended well string element from alignment with an adjacent well head to a laterally adjacent one of said multiplicity of slots, or vice versa, without tilt or rotation of said element from vertical.

2. Apparatus in accordance with claim 1 wherein said cable means includes a pipe elevator for supporting said well string or elements thereof during transfer, and said element transfer means includes an upper pipe handling arm adjacent the active end of said cable means when elevated by extension of said hoist ram, and including means for gripping said well elements or said well string during transfer with said well element maintained a vertical position.

3. Apparatus in accordance with claim 2 wherein said element transfer means further includes a lower pipe handling arm including grip means for engaging the lower end of an element of said well string during racking or unracking thereof for movement, to or from, a slot directly adjacent said well head or alignment of said element with a well string in the well bore.

4. Apparatus in accordance with claim 1 wherein said single column mast includes at least an upper telescopic cylinder section extendable relative to the cylindrical base support, and said carousel includes a cylinder section supporting an upper annular rack rotatable around the outer circumference of said upper telescopic cylinder section.

5. Apparatus in accordance with claim 4 wherein said carousel further includes a sleeve member rotatably surrounding a stationary lower cylindrical portion of said telescopic mast and an annular support base for supporting the lower end of well elements racked within slots of said upper annular rack, said annular support base being rotatable with said sleeve and said upper annular support rack.

6. A well working rig comprising a single columnar mast for a well string hoist, said hoist including a crown block extending radially outwardly from said column mast and reciprocably mounted at the upper end of hydraulic hoist means for extension above the upper end of said mast, at least a pair of sheaves equally spaced from each other at opposite ends of said crown block and cable means extending across said sheaves and vertically downward, one end of said cable being adapted to suspend a well string vertically from one of said sheaves, and the other end of said cable extending vertically downward through the opposite sheave to stationary anchor means, a rotatable annular pipe racking carousel surrounding and extending upwardly along said columnar support to an annular fingerboard below said reciprocably crown block, said fingerboard carousel including a multiplicity of radially extending slots, formed therein, each slot being adapted to engage a plurality of tubular elements along its radial length and an annular base rotatable with said fingerboard, said base being adjacent the lower end of said column for racking each of a multiplicity of tubular elements forming a well string parallel and adjacent to the well string suspending end of said cable, and means for laterally transferring tubular elements from said cable support means to a selected one of said carousel fingerboard slots and vice versa, without substantial rotation of the axis of said tubular element in a vertical plane to transfer elements laterally between the centerline of a well bore and a selected one of said fingerboard slots

7. Apparatus for automatically running tubular goods, including sections of pipe or rod, into or out of a well bore without manual handling of such pipe or rod sections to make or break couplings therebetween during assembly and disassembly of a well string in said well bore comprising;

an annular base surrounding a concentric column mast, said column mast including hydraulic actuator means extending upwardly from within said column and having reciprocable piston and cylinder members axially parallel with the axis of said column mast, said annular base including a plurality of tubular goods receiving means around the periphera of said column for vertical stacking of tubular sections of a well string to be assembled or disassembled in a well bore, with each of said sections being vertically parallel and rotatable to a position adjacent to said well bore, said hydraulic actuator including a cross beam having the central portion of its length affixed to the axis of the movable portion of said actuator and having at least one pulley mounted at one end thereof, said crossbeam extending radially outward beyond the periphery of said annular base member to position said one pulley over an adjacent well bore, at least another pulley laterally spaced from said one pulley at the other end of said crossbeam for simultaneous vertical movement therewith, wire line means having one end anchored to a stationary support and the free end thereof extending generally vertically through said one pulley for alignment with said adjacent well bore so that during reciprocation of said hydraulic actuator the free end of said wire line means travels at least twice the movement of said hydraulic actuator while maintaining equal and opposite movement of said cable at the ends of said crossbeam, elevator means for supporting sections of tubular goods including a complete well string at the free end of said wire line means, and manipulator arm means radially movable relative to the central axis of said annular base and said column mast for selectively grasping and transferring a section of said tubular goods while maintaining said section vertical throughout transfer of said section from radial alignment with the periphera of said annular base for vertical storage or retrieval of said section thereon for alignment of said sections with a work string in a well bore below the free end of said elevator means, whereby said manipulator arm means and said hydraulic actuator move vertically stored sections of said tubular goods from said annular base into alignment with a well for assembly into a work string and reverse said movements for disassembly and storage of said sections.

8. A method of inserting and withdrawing tubular sections, such as drill pipe, casing and sucker rods, forming a continuous well string in a well bore, each tubular section having threaded ends for coupling said sections together which comprises erecting a cylindrical column adjacent a well bore in which or from which tubular sections are to be assembled or disassembled, extending a reciprocal hydraulic actuator through the upper end of said cylindrical column, positioning an elongated movable crown block carrying sheaves adjacent its outer ends above and transverse to the central axis of said hydraulic actuator with one end of said crown block including one of said sheaves extending over an adjacent well bore, suspending a pipe elevator for lifting and lowering said well string in said well bore from one end of a cable system extending vertically downwardly from said one sheave, balancing the off-axis moment forces imposed on said column by loads supported by said elevator and said cable acting through said one sheave by extending the other end of said cable parallel to the length of said crown block and over the other of said sheaves to anchor means vertically aligned with said other end of said cable system, additionally stabilizing said cylindrical column against buckling and bending forces acting on the upper end of said cylindrical column by concentrically racking each of a multiplicity of said tubular elements on an annular carousel base surrounding the lower end of said cylindrical column, said multiplicity of sections being disposed radially outwardly from said column, and annularly around said base whereby substantially all weight of said sections is concentrated on said annular base and transferring each of said tubular sections by elevation of said crown block to a height sufficient to engage or disengage the upper and lower ends of each section on said base and then disengaging said section from said cable elevator and parallel to the well string in said well bore for lateral movement of said section with the axis thereof maintained substantially parallel to said well string throughout such transfer.

9. A method of inserting and withdrawing sections of tubular goods, such as drill pipe, casing, and sucker rods, wherein each section includes complementary threaded ends for coupling said sections together to form a continuous work string in a well bore, said method including disposing a single column mast in a generally vertical position adjacent to and generally parallel with the axis of a well head wherein a well string formed of interconnected sections of tubular goods, are supported in a well bore with an upper threaded coupling open to accept a complementary lower threaded coupling of another section, suspending the lower end of another tubular section with its lower end over said upper threaded coupling of said well string in the well bore from the active end of cable means supported by a sheave system, said sheave system including at least a pair of pulleys mounted on a crossbeam supported for vertical movement on the upper movable end of a hydraulic ram, said hydraulic ram axially extending from the upper end of said column mast, one of said pulleys generally aligning said active end of said cable means with said well bore and to axially align said other tubular section with said well string, an intermediate portion of said cable means extending over the other of said pair of pulleys, said other pulley being spaced laterally along said crossbeam and at a distance to equalize the moment load on said crossbeam relative to said hydraulic ram and said column mast, and the inactive end of said cable being stationarily anchored to maintain a vertical load on said other pulley equal to the load on said active end of said cable, and said equal loads are axially carried by said hydraulic ram to maintain a compression load only within the cross-sectional area of said single column mast, then threadably securing said other tubular section to said well string and lowering the extended well string into said well bore until the upper coupling of said other section is in position to accept an additional tubular section.

10. A method in accordance with claim 9 wherein the intermediate portion of said cable means additionally passes over a third pulley of said sheave system, said third pulley being vertically aligned with said other pulley of said pair of pulleys, and then over a fourth pulley positioned to the opposite end of said cable with the axis of said hydraulic ram, the support of said third and fourth pulleys being stationary relative to both said well head and said hydraulic ram then anchoring the dead end of said cable to said crossbeam so that movement of said hydraulic ram vertically extends or retracts the active end of said cable at least three times the movement of said ram to raise or lower the length of a tubular section before and after coupling said section to a work string in a well bore within a vertical work space one third of the movement of said section.

11. The method in accordance with claim 9 wherein the dead end of said cable is directly anchored to said crossbeam.

12. The method in accordance with claim 9 wherein anchoring of said dead end of said cable is through a further pulley mounted on said crossbeam and then affixed to an anchor laterally spaced and immovable relative to said well head.

* * * * *